United States Patent [19]

Smith

[11] 4,428,582

[45] Jan. 31, 1984

[54] APPARATUS FOR EDUCATIONAL GAMES

[76] Inventor: William Smith, 15040 Sprague Rd., Cleveland, Ohio 44130

[21] Appl. No.: 304,861

[22] Filed: Sep. 23, 1981

[51] Int. Cl.[3] ..... A63F 1/04

[52] U.S. Cl. ..... 273/296; 273/299; 273/305

[58] Field of Search ..... 273/296, 299, 272, 305

[56] References Cited

U.S. PATENT DOCUMENTS

| | | | |
|---|---|---|---|
| 622,240 | 4/1899 | Latham | 273/299 |
| 1,107,417 | 8/1914 | Ford | 273/299 |
| 1,109,543 | 9/1914 | Phipps | 273/296 |
| 1,188,204 | 6/1916 | Pitt | 273/296 |
| 1,191,419 | 7/1916 | Harrison | 273/299 |
| 1,557,824 | 10/1925 | Fritz | 273/296 |
| 2,042,930 | 6/1936 | Emmerich | 273/299 X |
| 2,574,328 | 11/1951 | Hartley | 273/296 |

*Primary Examiner*—Anton O. Oechsle

*Attorney, Agent, or Firm*—Woodling, Krost & Rust

[57] ABSTRACT

Apparatus is disclosed for the playing of a variety of educational games by players of all ages and skills. Cards or tiles are provided with numbers on one side and letters on the other.

7 Claims, 3 Drawing Figures

APPARATUS FOR EDUCATIONAL GAMES

BACKGROUND OF THE INVENTION

This invention relates to educational card games, and especially to a card deck which may be used to play a large variety of such games.

Many games have been devised in which the players compete to perform some cultural skill, such as arithmetic, logic or spelling, generally either with cards or tiles on a board. A few of these games have achieved a desired popularity. However, as a class they suffer from the disadvantage that the appeal of each is not universal. If a game is complex and challenging enough to hold the interest of adults or especially gifted children, it often either is beyond the intellectural abilities of children generally or requires a longer attention span than they possess. Conversely, a game which appeals to children seldom is satisfying for adults. Moreover, those games which primarily depend upon intelligence or vocabulary cannot satisfactorily be played by opponents of widely disparate skill. In order for them to compete in a meaningful way, a greater element of chance must be introduced into the game. A further disadvantage of many spelling games in particular is that the apparatus required, or the space required to play the game, is inconveniently large.

The profusion of such games not only demonstrates their educational utility and popularity, but also serves to point up the inability, described above, of each of them individually to appeal to all family members. It is not uncommon for a family to possess many such games, the transportation and use of which during vacations or other travel can be a great inconvenience.

There appears to be a great need for game apparatus which can serve many educational functions, which is versatile enough to provide an effective competitive arena for players with a wide variety of competences, which is compact enough to be easily portable, and which is not expensive.

SUMMARY OF THE INVENTION

My invention is a collection of playing pieces; they may be tiles but they are preferably cards. Each has alphabet letter indicia on one side and a number, drawn from a fixed set of numbers, on the other. The distribution of letters and numbers is not weighted by letter frequency but is completely even, each letter being paired with each number from the set exactly once. This apparatus is thus both simple and extremely versatile, for it may be used in a variety of both spelling and arithmetic games, and is equally adaptable to the words of any language, no matter what the frequency distribution of the letters may be. It is also adaptable to solitaire use, as will be seen below. In the playing card form it is ideally compact and inexpensive.

Accordingly, it is an object of my invention to provide game apparatus which is simple and versatile so that players of all ages and degrees of experience may benefit therefrom.

A further object of my invention is to provide versatile educational game apparatus which is compact and inexpensive.

That these and other objects have been achieved will be seen by the following detailed specification. For a better understanding of the invention, its advantages and specific modes of use, reference should be made to the accompanying drawings, in which.

DETAILED DESCRIPTION OF THE INVENTION

Figure 1:
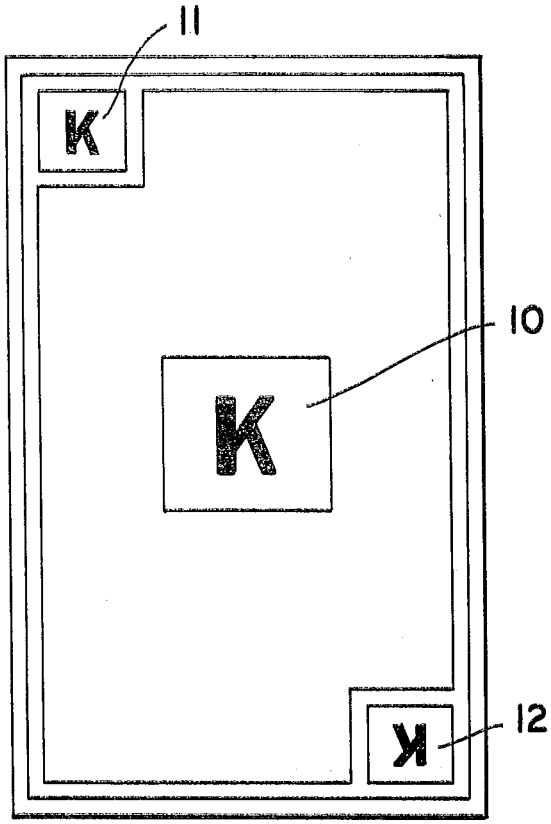
FIG. 1 is a view of one of the sides of a typical playing card from the deck of my invention.

In the preferred embodiment of my invention, the playing pieces are a deck of cards of approximately the same size as ordinary playing cards. Each card has letter indicia on one side and number indicia on the other side. For each of the 26 letters of the alphabet there are 5 cards in the deck; the 5 cards bearing that letter on their tops also bear, respectively, the numbers 1, 2, 3, 4 and 5 on their obverses. The total number of cards in the deck is consequently 26 times 5, or 130. While the number of cards for each letter can be increased or decreased, I have found that the number 5 is most satisfactory since the deck is easily shuffled, and if for example, only the number 1, 2 and 3 are desired to be used, the 52 cards with the numbers 4 and 5 on the back may be removed.

Figure 2:
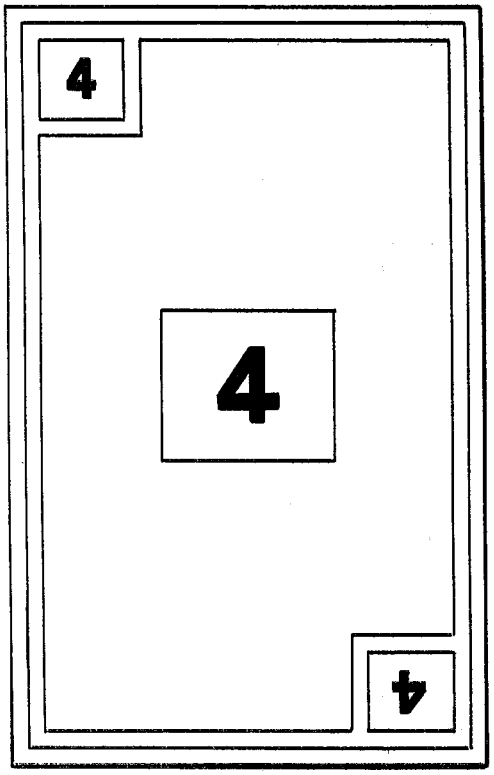
FIG. 2 is a view of the other side of the same typical card.

The design of one side of a typical card in my deck is shown in FIG. 1 and FIG. 2. The principal letter indicium 10 is printed in relatively large size in the center of the card, and the same letter indicium 11 is printed in a smaller size, with the same sense, in the upper left corner of the card. The letter indicium 12 is also displayed with the opposite sense—that is, rotated 180°, or "upside down"—in the lower right corner of the card. By this means, two objects are achieved: first, if cards are to be aligned to spell a word the cards can be arranged in overlapping fashion with only the upper left corners visible. This permits space to be saved both while holding the cards in the hand and while cards are displayed on the playing table. Secondly, the provision of the indicium in the lower right corner permits an opponent sitting opposite easily to read the letter of a card laid down before him. This is an especial advantage when the players are very young children. The number side of a typical card shown in FIG. 2, is designed similarly, except that one of the numbers from 1 to 5 is used instead of a letter.

Figure 3:
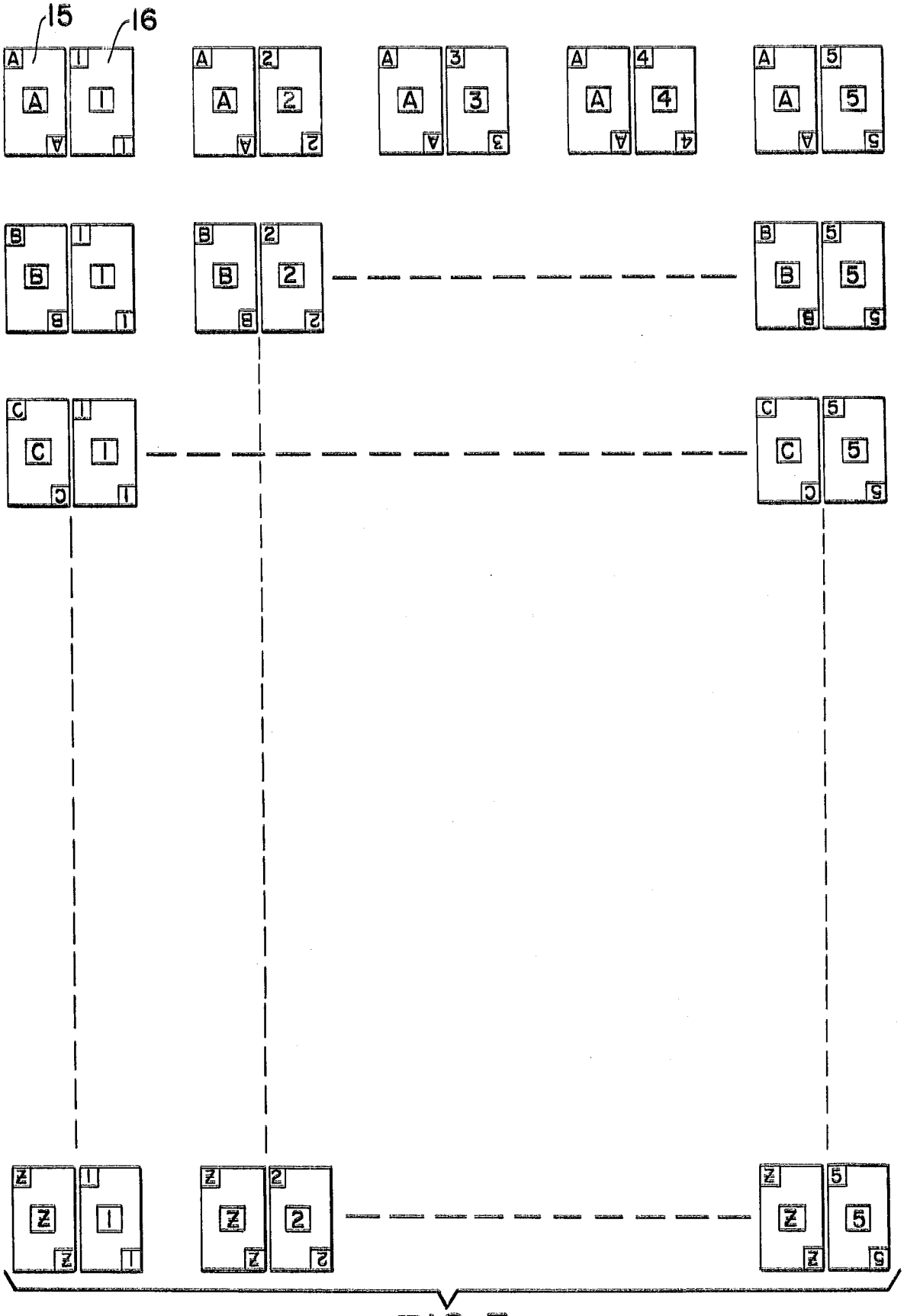
FIG. 3 is a partial view of the deck of my invention, the dashed lines representing cards not shown but understood as existing in an analogous relationship to those shown.

FIG. 3 shows a portion of the entire deck laid out schematically in matrix form. The card "pair" 15, 16 represents the two sides of but one card. Thus, the top row shows the five cards with the letter indicium "A", the next row those five with letter indicium "B", and so on down to the five cards with letter indicium "Z".

Many interesting and educational games can be played with this deck of cards. The rules for some of these games follow.

MINI WORDS

OBJECTIVE: To be the first to spell words of three or more letters or abbreviations of two or more letters.

PLAYERS: 2 to 6. AGE: 8 to Adult.

WINNER: First player to score a total of 100 points.

RULES: The deck is shuffled, numbers up. Each player is dealt seven cards. The dealer places the deck onto the playing surface and the players turn their cards over, spelling as many words and making as many abbreviations as possible.

Once a player has turned a card over, in an effort to spell a word or make an abbreviation, he is not allowed to again turn the card over, as that would allow him to see and take advantage of highest number of two cards of the same letter.

If no word or abbreviation can be made, each player may return any letters, to a limit of four, the returned letters forming a discard deck, letters up.

If a player spells a word or words, or makes an abbreviation or abbreviations, he returns only the cards used in spelling the word(s) or making the abbreviation(s); those cards are placed on the discard deck.

On the next deal, each player is dealt a number of cards equal to the number returned.

SCORING: When a word is spelled or abbreviation made, the cards used are turned over and the numbers are added giving the points scored. Full score is awarded for words, half score for abbreviations.

Should all seven cards be used in spelling a word or making an abbreviation, two extra points are awarded. Should all seven cards be used in spelling two words or more—making two or more abbreviations—or spelling a word(s) and making an abbreviation(s), one extra point is awarded.

An additional extra point is awarded to the first player to call, "Got One" (meaning he has spelled a word or made an abbreviation); the last player to call "GOT ONE", is penalized one point for being the last to spell a work or make an abbreviation.

Those players who call "GOT ONE", but who are neither first nor last to call "GOT ONE", are neither awarded nor penalized extra points. However, any player not spelling a word nor making an abbreviation during a hand of play is penalized one point.

When the cards from which dealing is done are exhausted, the deck of discards are shuffled and the game continues.

MAXI WORDS

MAXI WORDS is played in Mini Words with these changes: Dealing ten cards; allowing any five cards to be returned when no words are spelled nor abbreviations made. Doubling the number of letters required in spelling words and making abbreviations.

TO OBTAIN EXTRA POINTS: All ten letters must be used in spelling a word(s), making an abbreviation(s); or, making word(s) and an abbreviation(s). Extra points awarded or penalized are doubled.

HIGH CARD

OBJECTIVE: To have the card which you turn over have a higher number than those of the other player(s).

WINNER: The first player to score a total of 500 points.

PLAYERS: 2 to 6. AGE: 8 to Adult.

RULES: Each player is dealt five cards, numbers up. After the dealer places the deck onto the playing surface, players turn their cards over arranging them in alphabetical order from left to right. As each player arranges his cards, he calls "ARRANGED". Then each player (all players at the same time), turn over the card which is closest to his right. That procedure continues, one card at a time, until all five cards have been turned over. After each card is turned over, the player with the highest card collects the cards which have been turned over.

After a hand is played and points totalled, the cards used are stacked up to form a deck of discards, with numbers up.

SCORING: When all players have turned one card over, the player with the highest number showing collects the card which was turned over by the other player(s); upon conclusion of each hand of play, each player totals the numbers on the back of the cards collected, giving his score for that hand.

Should two players or more turn over identical numbers and another player has a higher number turned over, the above rule applies; should the two identical numbers be the highest turned over, they cancel each other and are put onto the discard deck. Then the player with the highest number showing collects the cards as before mentioned.

Should three players be playing and the two identical numbers turned over are the highest, no points are scored by any of the three players; likewise, should two be playing and turn over identical numbers, no points are scored.

The first player to arrange his cards in alphabetical order and call, "ARRANGED" is awarded an extra point; the last person to call, "ARRANGED" is penalized a point; those neither first nor last to call, "ARRANGED" are neither awarded nor penalized.

When the deck from which dealing is done is exhausted, the deck of discards is shuffled and the game continues.

HIGHEST SUM

OBJECTIVE: HIGHEST SUM is a quick version of HIGH CARD. The difference in rules: Each player turns over his right and left card; the player with the highest sum collects all five cards from each player. The total of his cards and the cards collected becomes his score for that hand.

HIT FIFTEEN

OBJECTIVE: To get exactly fifteen points.

WINNER: First player to score a total of 100 points.

PLAYERS: 2 to 8. AGE: 8 to Adult.

RULES: With the deck arranged letters up, each player in rotation is dealt three cards, numbers up. Thereafter, in rotation, each player must accept or decline the dealer's offer of the next card from the deck. Two declines constitutes a hold; the player who has held cannot resume acceptance.

SCORING: Players continue to accept the cards offered until they no longer wish to risk the next card dealt to cause their total to exceed fifteen.

If a player allows the sum of the numbers on the cards dealt him to exceed fifteen, no points are scored. Obtaining exactly fifteen earns five extra points; obtaining seven cards without going over fifteen earns five extra points.

All points fifteen and under are considered scored. Once all players have held, scored exactly fifteen, or have over fifteen, the points are credited and a new hand is played.

The cards used in playing a hand are discarded with the numbers up, forming a deck of discards. When the deck being dealt from is exhausted, the discards are shuffled and the game continues.

WORD RUMMY

OBJECTIVE: To spell as many words as possible during a hand of play. Any word spelled must have three letters or more. No abbreviations are allowed.

WINNER: First player to score a total of 500 points.

PLAYERS: 2 to 6. AGE: 8 to Adult.

RULES: Seven cards are dealt in rotation, numbers up. Each player then picks up his cards and aligns them in the manner desired, keeping the cards in his hand.

The top card is taken from the deck and turned (letters up), on the playing area, starting a line of discards. If the player starting first can use the first card on the discard line to spell a word, the player picks up the card spelling a word and discards. A card cannot be taken and held.

Should a player not pick up from the line of discards, he then draws from the deck. Cards drawn from the deck may be kept, used to spell a word, or discarded.

Should a player pick up the first card or cards thereafter from the line of discards, he forfeits his right to draw from the deck for that turn.

If a player takes cards from the line of discards, he must spell a word with the last card he picks up; he must keep or spell with all cards he takes from the line of discards. After he either picks up from the line of discards or draws from the deck, that player must discard before the next player takes his turn.

Once any player has spelled a word, any other player, (at his turn), may add a letter or letters to change the form of that word or change the word to another. (The letter or letters may be added at the front, the end, or anywhere throughout the word).

Should a player discard a letter which would change the form of an existing word or change an existing word to another, the first player to call, "PLAY" claims the letter, and applies it to the appropriate word.

This method of play continues until one of the players has no card left after discarding, at which time that hand of play ends.

SCORING: The numbers on the back of the cards used to spell a word are totaled, becoming that player's score for that hand of play. At the end of a hand of play, the players who have letters in their hand are penalized the total sum of the numbers on the reverse side.

Should the cards from which drawing is done become exhausted, the stack of discards is shuffled and used; however, all cards are collected and shuffled after each hand of play.

Should the line of discards become exhausted before a hand is over the hand of play terminates; no penalty is applied for cards in hand.

At all times, when a hand is either played or terminated, the words spelled and letters added on are scored and a new hand is played.

ALPHABET GIN

OBJECTIVE: To get any seven letters in alphabetical order.

WINNER: First player to score a total of 100 points.

NUMBER OF PLAYERS: 2 to 6. AGE: 8 to Adult.

RULES: ALPHABET GIN is played in the same manner as Word Rummy, with these changes: First player to obtain seven cards in alphabetical order wins that hand of play; the hand of play is over when any player obtains seven letters in alphabetical order—with or without having a discard. Should the eighth card—the card drawn—cause the other seven to be in alphabetical order, the eighth card is kept and applied and no discard is required. Should the top card of the line of discards or the next card below it cause a player's seven cards to become in alphabetical order he may pick up one or both; he may but is not required to have a discard, which would depend upon how the play is made. At no time does any player pick more than the top card and/or the one thereafter from the line of discards.

SCORING: The winner totals the numbers on the reverse side of his cards, obtaining his score for that hand; the loser(s) total numbers on the reverse side of the cards they have in alphabetical order—the loser(s) must have a minimum of four letters in alphabetical order before points for a portion of an alphabetical order towards seven letters are allowed. From that sum, subtract double the sum of the numbers on the reverse side of the cards which were not in alphabetical order; the difference (minus or plus) is the loser(s) score.

Should the first seven cards dealt be in alphabetical order, the player receives a score twice the sum of the numbers on the back of those cards.

NUMBER POKER

OBJECTIVE: To obtain the highest series, group, or set of numbers.

WINNER: Is determined by the following ranking of hands: The player with a 1 through 5 series; the highest group of the same number; (5 five's, 5 four's, etc.); a group of four of a kind (4 five's, 4 four's, etc., and having the highest fifth card); the highest group composed of two sets; (3 five's and 2 four's, etc.); a group of one set (3 two's and 2 non-like cards etc., or 2 three's and 3 non-like cards etc.).

PLAYERS: 2 to 6. AGE: 8 to Adult.

RULES: Each player is dealt five cards (letters up). After arranging his hand, he may return three cards in his effort to make groups. After each player returns the number of cards desired, a like number of cards are dealt. After the second dealing, groups are compared and the winner determined.

WINNING GROUPS: The series of 1 through 5 beats all groups or sets; five of any number beats five of any lower number; any four of a number, beats four of the same number with a lower fifth card; four cards of any number beats three cards of another, etc.

Three of any number beats three of any lower number regardless of the total of the other two cards; however, when two players have three of the same number, the player whose other two cards total the highest is the winner. This rule also applies to any two of the same card and the total of the other three.

Should the totals, series, groups, or sets be identical, there is a tie. All ties are broken by the tying players drawing from the deck until one draws a higher card than the other.

Groups of three cards of one number and two cards of another beat all other groups, in numerical sequence, also beating all combinations except a series of 1 through 5, or five of any number.

Among groups, a group of three 5's and two 4's would beat three 4's and two 5's; three 3's and two 2's would be three 2's and two 3's, etc.

The game of Number Poker can be scored by totalling the numbers which appear on the cards possessed by the winner. The first player to obtain 500 points is the winner.

NUMBER RUMMY

OBJECTIVE: To make sets of the same numbers composed of two, three, four, or five of the same number.

WINNER: First player to score a total of 500 points.

NUMBER OF PLAYERS: 2 to 6. AGE: 8 to Adult.

RULES: The procedure for playing Number Rummy is the same as Word Rummy with these changes: The cards are dealt (letters up), the first card is removed from the deck and placed (number up) to start a line of discards.

If a player makes a set of less than five numbers, then at any later time, any player may at his turn add one or more like numbers to complete a set of five of the same numbers. Also once a series of consecutive numbers have been started, any player may at his turn add one or more numbers to complete the series of 1 through 5.

Should a player discard a number which can be played on a series or set, the first player to call "PLAY" claims the card and applies it to the appropriate series or set.

SCORING: The winner of the hand is the first player to use all cards in his hand. He totals the numbers on the cards used in making sets, or series. The loser(s) likewise total their points earned; from that total is subtracted the sum of the numbers on the cards which they have in hand when another player won that hand of play—the difference of those totals (plus or minus) is the loser(s) score for that hand of play.

LETTER RUMMY

OBJECTIVE: To make sets of the same letters composed of three, four, or five letters, or to make a series of three or more letters in alphabetical order.

WINNER: First player to score a total of 500 points.

NUMBER OF PLAYERS: 2 to 6. AGE: 8 to Adult.

RULES: The procedure for playing Letter Rummy, is as for Number Rummy; the series of an alphabetical sequence may run from A to Z, from any point between either end of the alphabet.

LETTER POKER

OBJECTIVE: To get as many of, or all of a particular letter group as possible.

WINNER: First player to score a total of 500 points.

NUMBER OF PLAYERS: 2 to 6. AGE: 8 to Adult.

RULES: Five cards are dealt, (numbers up). Once the cards are arranged in the player's hand each player may return any cards to a limit of three.

After the cards are in hand, a player may not look at the number on the reverse side. Once the number of cards each player wishes to return have been returned, each player is dealt a number of cards equal to the number returned. After the second dealing, points for groups are counted; each player is penalized for cards with which he was unable to form a group. Penalty: the total of the numbers on the reverse side of the cards which he did not use in forming a group.

SCORING: Regular points are scored by adding the numbers on the reverse side of the letters used in forming groups; additional points are score in the following manner: Five of one letter—five additional points; four of one letter—four additional points; three of one letter—three additional points.

No additional points are scored for two of the same letter. No individual letters are counted as points. If a player does not obtain two of the same letter, he is penalized five points for that hand of play.

ALPHABET SOLITAIRE

OBJECTIVE: To obtain five sets of the alphabet—in alphabetical order—before the deck beats.

RULES: From left to right a line of five cards are dealt onto the playing surface in the following manner: With the deck, numbers up, the first card is dealt letter up. The 2nd, 3rd, 4th and 5th is dealt—number up. Onto the 2nd card from the left a card is dealt letter up. Onto the 3rd, 4th and 5th cards, a card is dealt number up. Onto the 3rd card from the left a card is dealt letter up; onto the 4th, and 5th card a card is dealt number up. Onto the 4th card from the left a card is dealt letter up. Onto the 5th card from the left a card is dealt letter up. The result is an array of fifteen (15) cards in five (5) row with the first row having one (1) card; the second two (2) cards; the third (3) cards; etc.; with the last card of each row having a letter showing—completing what is called the base group.

All alphabetical sequences (lines of cards) in the base group progress in alphabetical order from the letter showing toward the beginning of the alphabet. Should the top letter of a line of cards in the base group be an E the letter(s) added would be: D, C, B, A,—and in that order.

The sequence: E, D, C, B, A, would be placed in what is called the building group; and the alphabetical order reversed to: A, B, C, D, E.

All alphabetical sequences in the building group progress from A through Z and in that direction, whereas alphabetical sequences in the base group progress from the letter showing toward the beginning of the alphabet. Never does the direction of a sequence change, until a sequence of either base comes into alphabetical order with a sequence of the other base. When so, they are arranged in alphabetical order from A to z with the Z left showing to signify the obtaining of one set of the alphabet.

From the remaining deck—after the base group has been made—letters are placed into or added to the base and building groups in the following manners.

MANNERS OF PLACING LETTERS INTO EITHER GROUP: From the deck with numbers up cards are counted off—three at a time—the third card is turned so as to have the letters showing; only the letter of the third card is considered. For application to an alphabetical sequence, however, it is considered for both groups. If in alphabetical order, it is applied; if not, they are left laying on the playing surface. They and the other cards counted from the deck become a pile of discards. Thereafter, three more cards are counted and given the same consideration; cards are so counted and considered until the deck is exhausted. When the deck is exhausted, the pile of discards becomes the deck; they are not reshuffled.

Should the application of the third card cause any letter(s) of any sequence of any group or intergroup to come into alphabetical order, letters are applied until the chain reaction stops. This rule also applies to the top card showing on the pile of discards.

Should the third card from the deck be an A, it is placed as the beginning of an alphabetical sequence in the building group.

As the letters are applied from the line of cards in the base group, when the number shows, the card is turned over showing the new letter to be applied.

Only when a line of letters of the base group is exhausted, or placed into the building group, is a new line started; a new line is started by and when the letter Z is the third card from the deck.

Should the deck become exhausted in an uneven manner, the extra card(s) are placed onto the pile of discards; should there be two cards, the second is turned letter up and considered; should there by only one card, it is likewise turned and considered.

Should there be no pile of discards and less than three cards remaining of the deck, the remaining cards are considered.

Before obtaining five sets of the alphabet, should you go through the deck—three cards at a time—without applying any letter to the sequence of either group, the deck has won.

MINI MATH

OBJECTIVE: To obtain 500 points.

WINNER: First player to obtain 500 points.

NUMBER OF PLAYERS: 2 to 6. AGE: 8 to Adult.

RULES: Each player is dealt five cards number up. After the dealer places the deck onto the playing surface, the players turn their cards over arranging them in alphabetical order from left to right. As each player finishes arranging his cards, he calls "ARRANGED". The rule for dealing and arranging cards is the same for all Mini Math games. In any games, when the left card is subtracted from the right or vice versa, should the remainder be zero, the answer to that problem is zero.

As quickly as "ARRANGED" is called, the player continues on toward and in the manner stated to solve the problem; upon solving the problem, calling out the answer.

MINI MATH GAMES

GAME: SUM TIMES SUM—Is played by adding the left and the right cards, multiplying that sum by the sum of the other three cards.

GAME: REMAINDER TIMES SUM—Is played by subtracting the left card from the right or, should the left card be of a higher number than the right, subtracting the right from the left. The remainer is multiplied by the sum of the other three cards. The answer is multiplied by (−1) if the left card was higher than the right.

GAME: SUM DIVIDED BY SUM—Is played by adding the left and the right cards, dividing that sum into the sum of the other three cards.

Some answers will have whole numbers only, some whole numbers and fractions, others, only fractions. All fractions must be reduced to their lowest form.

GAME: SUM DIVIDED BY REMAINDER—Is played by subtracting the left card from the right or, should the left card be of a higher number than the right, subtracting the left from the right. The remainder is divided into the sum of the other three cards. The answer is multiplied by (−1) if the left card was higher than the right.

GAME: SUM MINUS REMAINDER—Is played by subtracting the left card from the right; the remainder is subtracted from the sum of the other three cards. Give a positive answer.

Should the left card be of a higher number than the right, subtract the left from the right; then, subtract that sum from the sum of the other three cards. Give a negative answer.

Scoring: The answer—minus or plus—to the problem, minus the penalty points, plus extra points, is the player's score toward obtaining 500 points.

All 500 points may be obtained by playing one particular Mini Math game; or the games may be varied, the points from each game totaled toward 500.

Extra Points: The first player to call "ARRANGED" is awarded an extra point; the last player to call "ARRANGED" is penalized a point; players who are neither first nor last to call "ARRANGED" are neither awarded nor penalized.

The first player to call the answer to his problem is awarded two extra points; the last to call the answer to his problem, and those unable to solve their problem, within the allowed time, as agreed to by the players, are penalized two points.

Those who are neither first nor last to solve their problems are neither awarded nor penalized.

When the answer to a problem is zero, no points are awarded for being the first to call the answer.

Any player calling the wrong answer to his problem is penalized five points.

STRATAGEMS

OBJECTIVE: To win points by forming arithmetic expressions.

PLAYERS: 2 to 6. AGE: Advanced players.

WINNER: First player to obtain 100 points.

RULES: The cards with any of the letters P, M, T, or D are separated from the rest of the deck; the game is played with only those 20 cards. Each player is dealt two cards with the numbers up. A single card is turned letter up in the center of the players to begin a "discard" stack, and the undealt portion of the small deck is placed in a "deck" stack, numbers up, next to it. Each player may pick up and examine the reverses (letter sides) of his two cards without revealing them to the others.

Play begins when the first player draws his choice of either the single letter-up card from the discard stack, or the top number-up card from the deck.

Points are accumulated, primarily by forming arithmetic expressions of this form: number, letter, number. The letters P, M, T and D represent respectively the operations "plus", "minus", "times" and "divided by". (If desired, the letters A, S, M, D, respectively, may be used instead.) For example, if the player has the cards 2D, 3T and 5T, he may use the card 2D in the middle to form the expression 3D5 or 5D3. Or, using one of the other cards in the middle, he may form 2T5, 5T2, 2T3, or 3T2. He lays down his chosen expression in front of him and receives as his score the value of that expression.

The value of an expression is ordinarily the result of the arithmetic operation it indicates. For example, 2T5 has the value 2 times 5, or 10. 5M3 has the value 5 minus 3, or 2. A special rule is used for scoring convenience when the expression has D ("divided by") in the middle: any fractional result is rounded up. Thus, for example, 4D5=1, 4D4=1, 4D3=2, 2D5=1.

Another way of earning points is by accumulating either three "D" cards (earning 30 points) or three "M" cards (40 points) in one hand. The hand is laid down with all letters up. In all cases but DDD or MMM, the expression laid down must be of the form number, letter, number.

After laying down his expression, the player concludes his play by discarding any one of the three cards he has laid down, letter up, on the discard stack. He leaves the other two cards on the table as they were laid down.

The second player's two cards were dealt number up so that the first player knows what the numbers on those cards were, but not the numbers. The first player may thus choose his discard to avoid as much as possible benefitting the second player. The second player may or may not know what the number on the other side of the discard is, but he does not know the letter on the other side of the deck card. He then picks up either the discard or a card from the deck, as he chooses. The second player then lays down an expression, usually the highest-valued one he has, and receives its value as his score. He discards one of those cards, again letter up, on the discard pile.

In the same way, each player in turn picks either a deck card or the discard. He examines all three cards to choose the expression which he wishes to form and at the same time chooses which of the three cards to discard from those laid down.

There are certain strategic considerations resulting from the balancing of the goals of maximizing one's score and of minimizing that of others. For example, it is important to remember as much as possible about one's neighbor's cards and the cards already discarded. The tendency to keep the "T" and "P" cards in one's hand will be offset by the danger of another's obtaining the high-scoring DDD or MMM cards. Also, it is not mandatory to lay down the combination of highest score. A player may choose to sacrifice a few points in order to avoid revealing information about the reverses of his cards.

Should the deck stack become exhausted, the discard stack is turned over, to become the deck, which has always numbers up. One card is turned over again from atop it to start a new discard stack, which has always letters up.

Play continues until one of the players reaches a winning score of 100 points.

If desired to make the game more difficult, the players may agree that it will be forbidden to look at the reverses of one's own cards from the time they are laid down until after a card is picked up on one's own next play.

COMPETITION

OBJECTIVE: To obtain a given number of alphabetical sets.

NUMBER OF PLAYERS: 2 to 5. AGE: 8 to Adult.

WINNER: The first player to obtain a given number of alphabetical sets. After beating the other player(s), the winner may continue trying to obtain all five sets of the alphabet—beating the deck as well as the other player(s).

GIVEN NUMBER OF ALPHABETICAL SETS: The number of alphabetical sets needed to win is determined by the number of players. Two Players: the winner must obtain three sets; Three Players: the winner must obtain two sets; Four Players: the winner must obtain two sets; Five Players: the winner must obtain one set.

BEATING:

(a) When two are playing, should a player obtain four of the A's, the other is beaten.

(b) When three are playing, should a player obtain three A's, if any one of the other players has an A the other is beaten. If neither has an A, they are tied. The tie is broken by and in favor of the first to obtain an A. Should the player who has three A's obtain another before the tie is broken, the tied players are beaten.

(c) When four are playing, should two players obtain two A's, the other players are beaten. Should a player obtain three A's and another player obtain one A, the other players are beaten. Should a player obtain four A's, the other players are beaten.

(d) When five are playing, should a player obtain two A's, the player without an A and having the letter nearest to Z in the base group is beaten; that rule applies each time any player gains more than one A, and some player doesn't have an A. Should there be a tie, the tie is broken in favor of the player who is first counted off an A as the card to be considered for application, or who is the first to place a letter the farthest away from the Z in any line of his base group. Each tied player gets the right to try to break the tie. Should the effort to break the tie result in another tie, the process is repeated until the tie is broken.

RULES: As for Alphabet Solitaire, with these changes: Each player deals himself a base group. The remaining deck becomes a common deck from which cards are counted, two at a time. The second of the cards so counted is placed letter up, starting a pile. The so counted and placed card becomes the card which the player considers for application to any alphabetical sequence of either group.

No player is to consider the card counted for another. If a player cannot apply the card counted for him and showing, he calls "Pass", and two cards are counted, placed, and offered to the next player.

Should any player apply the card offered, such application would cause the next card on the pile to become visible and subject to application; application of cards uncovered continues until the chain reaction of applying letters stops.

Once a player applies the card counted and offered, and his chain reaction stops, the next player has the option to apply the card uncovered and showing on the pile (he cannot apply the card dealt to another) or, he may have two cards counted from the deck, the second being offered for application. If applicable, that card is applied as well as the chain reaction which may result.

When the deck from which cards are counted is exhausted, the pile of cards is used.

From the first deck, or such time as the pile of cards is made into another deck, any player who doesn't apply a letter before the deck is exhausted has been beaten. When beaten by the deck or another player, the beaten player's groups are combined with the pile, and the other player(s) continue to compete against each other and the deck until a winner emerges.

PYRAMID

A game for advanced players which requires the player to plan the formation of each level of the pyramid so as to have the letters of that formation (abbreviation, word, or acronym) interlock with the letters of the formation on the next level(s) in such a manner as to make a vertical formation. Making vertical formations is not required in construction of a pyramid, however to do so is advantageous to total points scored.

OBJECTIVE: Build a pyramid formed of words, abbreviations and/or acronyms; no apostrophes permitted (cannot as opposed to can't). When hyphenated word is used, no space is allowed for hyphen.

WINNER: Player obtaining highest score.

RULES: Player must build a pyramid in the following manner: A base word of nine letters, followed by parallel words of seven, five, and three letters; the pyramid's apex must be the letter A.

The player is always dealt two cards more than the number of cards required in the formation that the player is making. Once a card is placed on the playing surface, the player cannot turn the card over to view the number.

With the deck numbers up, each player is dealt eleven cards, letters up. An effort is made to form a base word of nine letters. If no base word is formed, player may return a limit of two cards.

Returned cards are placed letters up onto a stack of discards. The player is then dealt two cards from the deck.

As each player makes a desired formation, that player has the option of keeping the two cards not used and being dealt the number of cards needed to make the next formation; or player may return the two unused cards and be dealt two cards more than the number needed to make the next formation.

That procedure continues as each player makes the base formation of nine letters and tries to make the next required formation of seven letters, etc., until the pyramid is completed.

EXAMPLE: Pyramid is:

A
BOY
SHOES
CIRCLES
COURTLAND.

At his turn of play, a player may place one or two cards on discard stack and receive an equal number from the deck. He may take both or either of the top two discards. If one is taken, the top card from the deck is dealt from the deck; if both are taken, no cards are dealt from the deck.

Regardless of the option taken, the player must place two cards on the discard deck. If the first option is taken, the player must place the cards on the discard deck prior to being dealt a like number of cards. If two cards are taken from the discard stack, two are returned, and no cards are dealt. If one card is taken, then one card must be placed on the discard stack before the other card due player is dealt.

TRADING FOR THE LETTER A: Because the letter A is required as the apex of each pyramid, players are allowed to trade an A for any letter needed or for a completed word. A's are not counted as part of the total number of cards allowed in an effort to make a formation. A's may be laid aside. One may be used as the apex of a pryramid, the others for bargaining.

SCORING: The first player to construct a pyramid is awarded Ten Extra Points. If an abbreviation, word or acronym is formed in a vertical manner, it has a point value in relation to its point of origin in the pyramid. A vertical formation may start anywhere in the pyramid but must end at the base, as illustrated in the pyramid example.

Formations originating at the second level (Example: the abbreviation CO.) have a point value of ten. Formations originating at the third level (Example: the word SEA) have a point value of fifteen. Formation originating on the fourth level (Example: the word YELL) have a point value of twenty. Should a formation start with the apex, the formation made has a point value of twenty-five.

When the apex is used in a vertical formation and a letter in a word on each level is used to start a vertical formation, a bonus of fifty points is awarded. When the apex is used in a vertical formation, and every letter in a word on each level is used in a vertical formation, a super bonus of 100 points is awarded.

After all extra points, point values and bonuses are totaled, all letters used in constructing the pyramid are turned numbers up and totaled. That total is added to the total of extra points, point values and bonuses for a total score.

An extended version of Pyramid may be played by totaling scores toward 500 points; the first player to obtain 500 points is the winner of the extended game.

PLAYING AS TEAMS: Teammates may assist each other with transfer of letters or words and advice. Each teammate may build a separate pyramid, in which case they, as a team, must build a number of pyramids equal to the number of players on the team; or each team may work to construct one pyramid.

Because Pyramid is a game of strategy and advanced abilities, it is suggested wild cards not be used in constructing pyramids. If wild cards are used, no bonus or super bonus points are awarded. If wild cards are used, the letters represented, which may be different letters in the horizontal formation than the vertical formation, have point value five.

It will be readily seen that the above examples are merely illustrative of the innumerable number of games that may be played with this deck. For example, should one wish to encourage proficiency in languages, any of the word-forming games may be adapted to require the formation of words only in a given language or languages. To make many of the games described herein more exciting and difficult, the cards corresponding to certain letters or to certain numbers, or a random set of cards, may be removed from the deck prior to play. Or it may be desired to designate certain cards or letters as earning a multiple of their usual score.

The deck itself has been shown in its preferred embodiment having the English alphabet and the set of Arabic numerals from 1 to 5 thereupon, but the invention comprehends the use of any alphabet and any set of numbers expressed with any numerals, so long as each alphabetical character is paired with each number on exactly one card. It may also be desired to provide some card or cards which are blank on one or both sides to serve as "wild" cards.

Although this invention has been described in its preferred form and preferred practice with a certain degree of particularity, it is understood that the present disclosure of the preferred form and preferred practice has been made only by way of example and that numerous changes in the details of construction and the combination and arrangement of parts and steps may be resorted to without departing from the spirit and the scope of the invention as hereinafter claimed.

I claim:

1. Playing apparatus comprising a set of playing pieces, each said piece being generally flat and having a top and a bottom side, said top side bearing thereupon a letter indicium or indicia corresponding to one letter of an entire alphabet, but bearing no number, and said bottom side bearing thereupon a number indicium or indicia corresponding to one number from a fixed preselected set of numbers, but bearing no letter, and in which for each selection of one letter of said entire alphabet and one number from said set of numbers, there is one and only one playing piece in said set having said letter on its top side and said number on its bottom side, the number of pieces in said set of playing pieces therefore being equal to the number of letters in said entire alphabet multiplied by the number of numbers in said fixed preselected set of numbers, said number of numbers in said set being in excess of one.

2. The apparatus of claim 1 and in which said alphabet is the English alphabet.

3. The apparatus of claim 1 in which said set of numbers consists of all the positive integers, from and including 1, up to some positive integer n.

4. The apparatus of claim 2 in which said set of numbers consists of all the positive integers, from and including 1, up to some positive integer n.

5. The apparatus of claim 4 in which n is less than or equal to 5.

6. The apparatus of claim 1 or claim 5 in which said playing pieces are playing cards.

7. The apparatus of claim 6 and in which said top side of each of said playing cards bears a principal letter indicium in the center of said top side and bears smaller letter indicia of the same letter in the upper left-hand and lower right-hand corners of said top side, one of said smaller letter indicia being rotated 180 degrees with respect to said principal letter indicium, and in which said bottom side of each of said playing cards bears a principal number indicium in the center of said bottom side, and bears smaller number indicia of the same number in the upper left-hand and lower right-hand corners of said bottom side, one of said smaller number indicia being rotated 180 degrees with respect to said principal number indicium.

* * * * *